US007578067B2

(12) United States Patent
Rager

(10) Patent No.: US 7,578,067 B2
(45) Date of Patent: Aug. 25, 2009

(54) BOW SIGHT STRUCTURES

(75) Inventor: Christopher Rager, Bozeman, MT (US)

(73) Assignee: Bear Archery, Inc., Evansville, IN (US)

( * ) Notice: Subject to any disclaimer, the term of this patent is extended or adjusted under 35 U.S.C. 154(b) by 32 days.

(21) Appl. No.: 12/015,034

(22) Filed: Jan. 16, 2008

(65) Prior Publication Data

US 2008/0168671 A1 Jul. 17, 2008

Related U.S. Application Data

(60) Provisional application No. 60/880,928, filed on Jan. 16, 2007.

(51) Int. Cl.
*F41G 1/467* (2006.01)

(52) U.S. Cl. ..... 33/265; 33/297; 124/87

(58) Field of Classification Search ..... 33/265, 33/297; 124/87, 88
See application file for complete search history.

(56) References Cited

U.S. PATENT DOCUMENTS 4,166,324 A * 9/1979 Carollo et al. ..... 33/265
5,094,002 A * 3/1992 Saunders ..... 33/265
6,601,308 B2 * 8/2003 Khoshnood ..... 33/265
7,082,690 B1 8/2006 Khoshnood
RE39,686 E 6/2007 Khoshnood
2003/0046820 A1 * 3/2003 Rager ..... 33/265
2005/0138824 A1 6/2005 Afshari
2006/0005406 A1 * 1/2006 Afshari ..... 33/265
2007/0113411 A1 * 5/2007 Rager ..... 33/265
2008/0222904 A1 * 9/2008 Erhard ..... 33/265

OTHER PUBLICATIONS

Impact Archery 2007 Bowsights Catalog, pp. 1, 7 and 11.
Cobra Bow Hunting Products 2007 Catalog, pp. 1, 5 and 8.
Black Gold Premium Bowsights 2007 Catalog, pp. 1, 2 and 6.
Fuse Accessories Product Guide 2007 Catalog, pp. 1, 4 and 5.

* cited by examiner

*Primary Examiner*—G. Bradley Bennett
(74) *Attorney, Agent, or Firm*—Woodard, Emhardt, Moriarity, McNett & Henry LLP

(57) ABSTRACT

One aspect of the present disclosure relates to a pin and sight point shape configuration for enhancing sight point visibility. Another aspect of the present disclosure relates to a pin configuration including a pin portion, an integral pin mounting portion, and an integral spool adapted to be positioned offset to one side of a bow sight.

20 Claims, 15 Drawing Sheets

BOW SIGHT STRUCTURES

This application claims the benefit of provisional application Ser. No. 60/880,928 filed Jan. 16, 2007.

TECHNICAL FIELD

The present application relates generally to archery equipment. More particularly, the application relates to aiming devices for bows.

BACKGROUND

A bow sight is used to assist an archer in aiming a bow. A typical bow sight includes a sight housing secured to the frame of a bow by one or more brackets. The sight housing often defines a viewing opening (i.e., a sight window) through which an archer can frame a target. The bow sight also typically includes at least one sighting member that projects into the viewing opening. The sighting member defines and supports a sight point. The sight point is the point the archer aligns with the target during aiming. In use, the archer draws the drawstring of the bow and adjusts the position of the bow so that the intended target is visible through the viewing opening. While continuing to peer through the viewing opening with the bowstring drawn, the archer adjusts the position of the bow so that the sight point aligns with the intended target from the archer's eye. Once the sight point is aligned with the intended target, the archer releases the bowstring to shoot the arrow.

Many bow sights are equipped with multiple sighting members. The sighting members are typically arranged so as to define a plurality of separately visible sight points positioned vertically one above the other. The vertical positions of the sight points are preferably set so that each sight point corresponds to a different target distance. The sighting members are generally arranged in either a vertically aligned orientation (e.g., see U.S. Pat. No. 6,418,633, which is hereby incorporated by reference), or a horizontal orientation (see U.S. Pat. No. 5,103,568).

Sight point visibility is an important consideration in bow sights. To increase sight point visibility, many bow sights use fiber optic members (e.g., scintillating optical fibers) to define sight points. Such fiber optic members are capable of collecting ambient light along their lengths. The collected light is internally reflected within each fiber optic member and emitted from an end of the fiber at the sight point. Longer fiber optic members are able to collect more ambient light and generate brighter sight points at their ends than shorter fiber optic members. To accommodate longer fiber optic members, various wrapping configurations have been developed (e.g., see U.S. Pat. Nos. 6,418,633 and 6,601,380).

SUMMARY

One aspect of the present disclosure relates to a pin and sight point shape configuration for enhancing sight point visibility.

Another aspect of the present disclosure relates to a pin configuration including a pin portion, an integral pin mounting portion, and an integral spool adapted to be positioned offset to one side of a bow sight.

Examples representative of a variety of inventive aspects are set forth in the description that follows. The inventive aspects relate to individual features as well as combinations of features. It is to be understood that both the forgoing general description and the following detailed description merely provide examples of how the inventive aspects may be put into practice, and are not intended to limit the broad spirit and scope of the inventive aspects.

DETAILED DESCRIPTION OF PREFERRED EMBODIMENTS

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

Embodiments of the present invention provide a sight pin and a sight pin structure useable to define a sight point for an archer. In some embodiments, the sight pin includes a sight point configuration to enhance use of the sight point. The pin preferably includes a fiber optic cable or strand to gather light and carry it to an end of the fiber optic cable arranged at the sight point. In certain embodiments, the pin includes a one piece shaft, central portion and spool which is mountable to the housing. Preferably the pin is vertically adjustable relative to the housing to allow an archer to sight the pin for a selected range. In certain preferred embodiments, multiple pins are mountable to the housing and independently adjustable to sight respective sight points for selected designated ranges.

Figure 1:
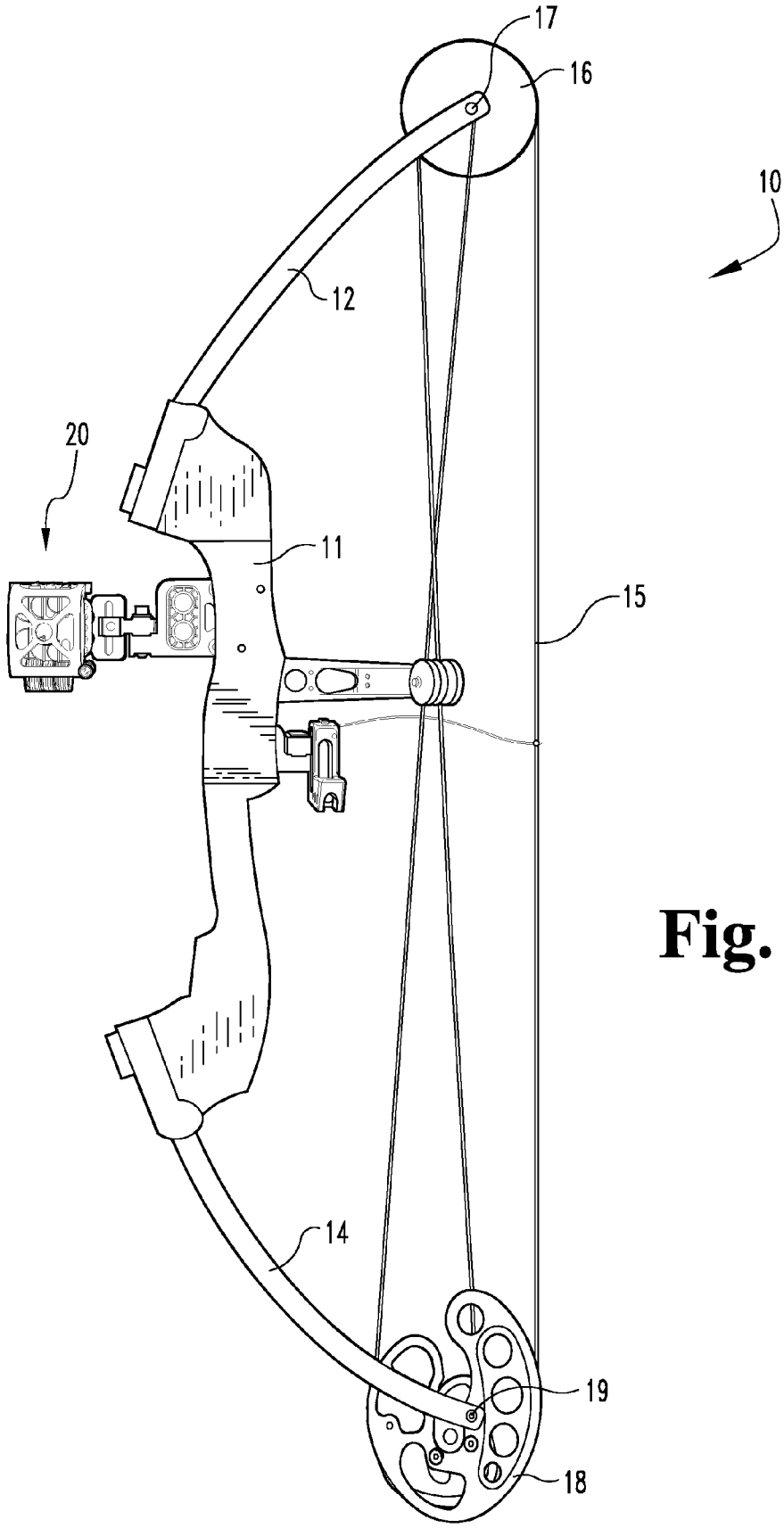
FIG. 1 is a view of an archery bow with a bow sight having inventive aspects in accordance with the principles of the present disclosure.

FIG. 1 illustrates one example of a conventional single cam compound archery bow generally designated as 10. When viewed from the perspective of an archer holding the bow 10, it includes a riser 11 with a handle, an upper limb portion 12, a lower limb portion 14 and a bowstring 15. Rotational members forming one or two variable leverage units such as idler wheel 16 and eccentric cam 18 are supported at the limb tip sections for rotary movement about axles 17 and 19. The upper and lower limbs can be solid or formed of pairs of parallel and symmetric limb portions sometimes called quad limbs. Idler wheel 16 is carried between the outer limb tip portions of upper limb 12. The lower pulley is carried between the outer limb tip portions of lower limb 14.

Bowstring 15 is arranged with upper and lower ends which are fed-out from idler wheel 16 and cam 18 when the bow is drawn. Bowstring 15 is mounted around idler wheel 16 and cam 18 as is known in the art. When the bowstring 15 is drawn, it causes idler wheel 16 and cam 18 at each end of the bow to rotate, feeding out cable and bending limb portions 12 and 14 inward, causing energy to be stored therein. When the bowstring 15 is released with an arrow engaged to the bowstring, the limb portions 12 and 14 return to their rest position, causing idler wheel 16 and cam 18 to rotate in the opposite direction, to take up the bowstring 15 and launch the arrow with an amount of energy proportional to the energy initially stored in the bow limbs.

Bow 10 is described for illustration and context and is not intended to be limiting. The present invention can be used with dual-cam compound bows, or can be used with single-cam bows as described for example in U.S. Pat. No. 5,368,006 to McPherson, hereby incorporated herein by reference. It can also be used with hybrid cam bows or recurve bows. The present invention can also be used in other types of bows, which are considered conventional for purposes of the present invention.

FIGS. 2-8 illustrate a bow sight 20 mountable on bow 10 having features that are examples of inventive aspects in accordance with the principles of the present disclosure. The bow sight 20 includes a sight housing 22 defining a viewing area such as a viewing opening 24 through which an archer peers when aiming a bow with the sight. The bow sight 20 also includes a plurality of upper sight pins 26*a-c* having vertical portions 28 that project downwardly from the sight housing 22 into the viewing opening 24. The upper sight pins 26*a-c* are positioned one behind the other with the vertical portions 28 generally aligned along a vertical plane 30 that bisects the sight housing 22. The bow sight 20 also includes lower sight pins 32*a-c*, having vertical portions 28 that project upwardly into the viewing opening 24. The lower sight pins 32*a-b* are also positioned one behind the other with the vertical portions 28 associated with the lower sight pins 32*a-c* generally aligned along the vertical plane 30 (shown as a dashed line in FIG. 2). The illustrated bow sight 20 further includes an optional level 34 positioned adjacent the viewing opening 24 adjacent to a front side of the bow sight 20. As used herein, the term "front side" means the side of the bow sight that faces toward the archer when the archer is aiming a bow.

In a preferred embodiment, each of the sight pins 26*a-c* and 32*a-c* supports a separate fiber optic member 36 having a light-emitting end at a corresponding sight point 38. For example, the sight pins 26*a-c* preferably can each support separate fiber optic members 36 with the light-emitting ends at the sight points 38. Similarly, the lower sight pins 32*a-b* can each support separate fiber optic members 36 with the light-emitting ends of those fiber optic members 36 being supported at the sight points. The sight pins 26*a-c* and 32*a-b* preferably include structure adapted to better demarcate, identify or otherwise accentuate the visibility of the sight points 38.

Figure 2:
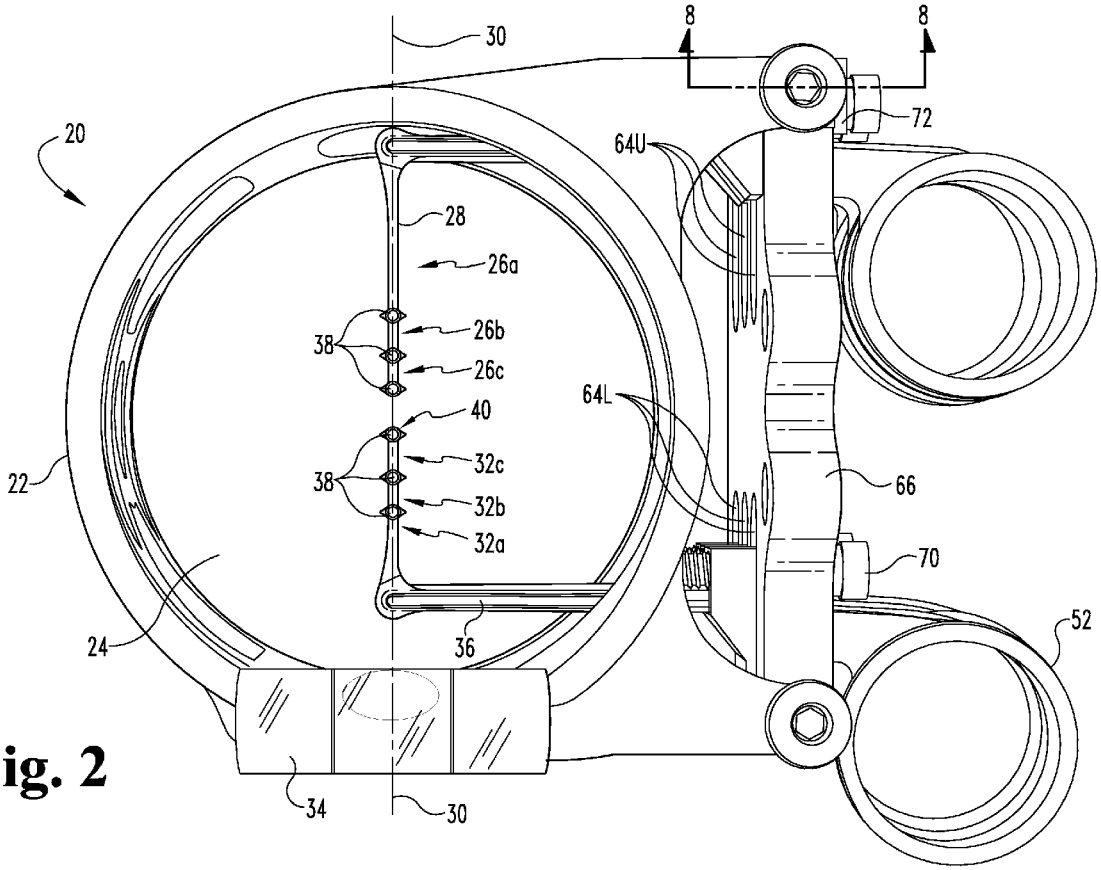
FIG. 2 is a front view of a bow sight having inventive aspects in accordance with the principles of the present disclosure.
Figure 2A:
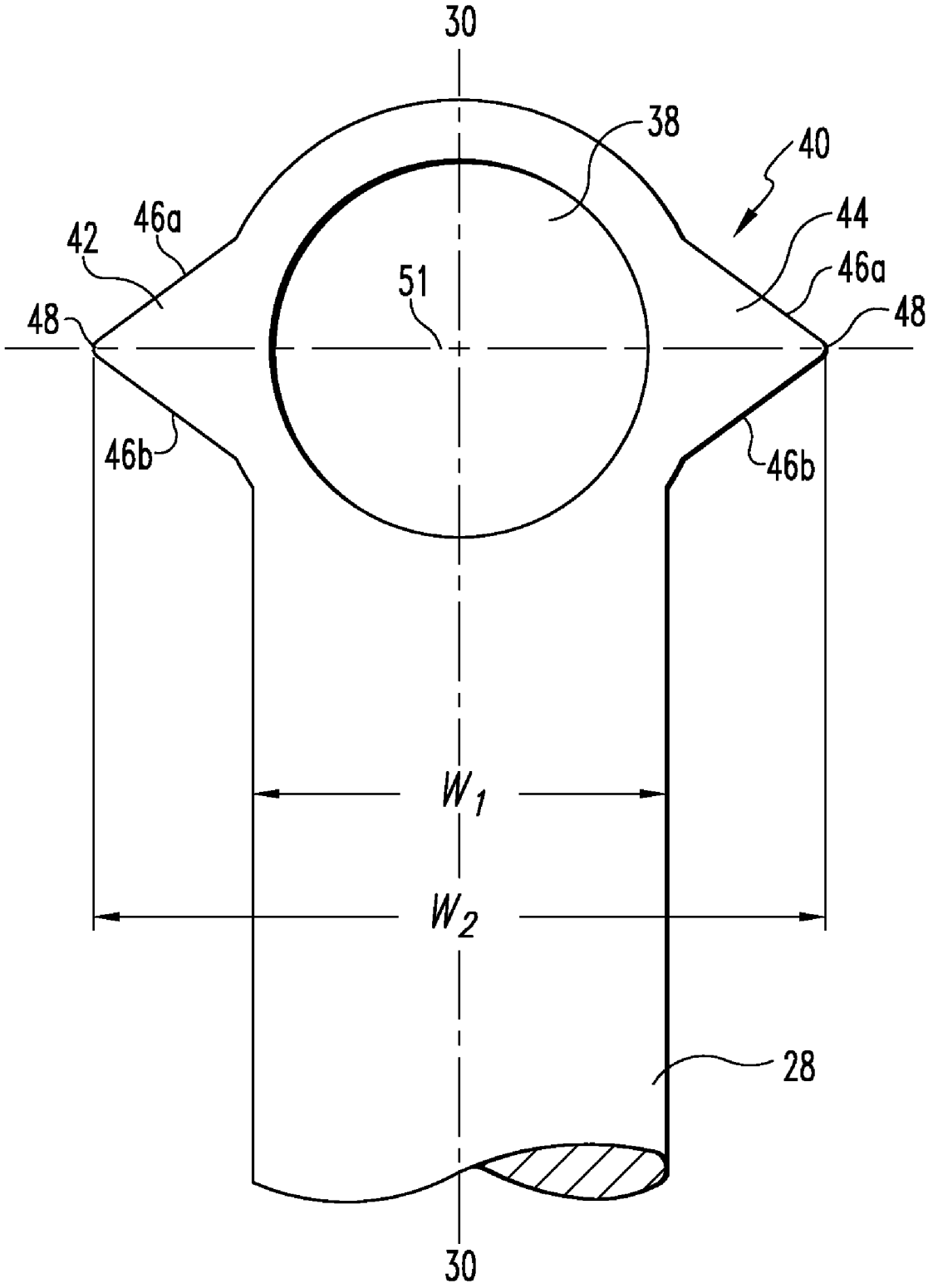
FIG. 2A is a front, perspective view of a sight point with two tick mark members.
Figure 3:
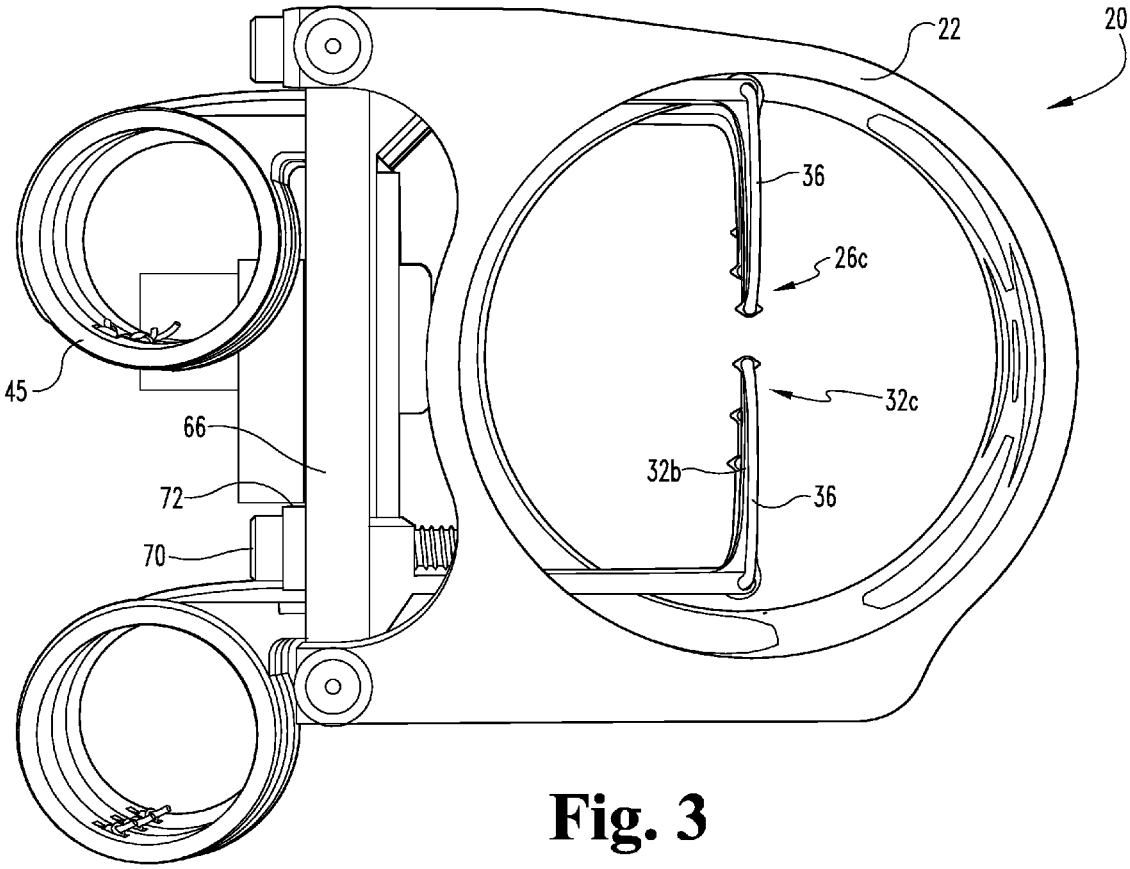
FIG. 3 is a rear view of the bow sight of FIG. 2.
Figure 4:
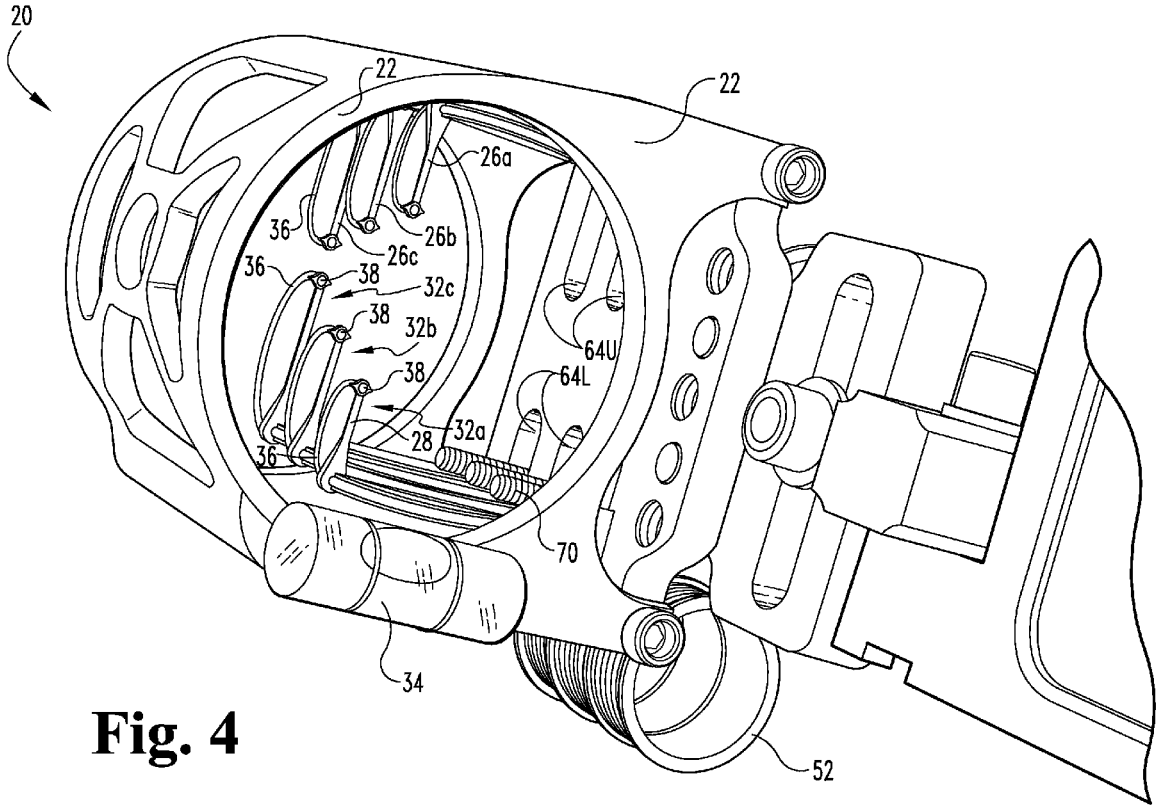
FIG. 4 is a front, perspective view of the bow sight of FIG. 2.
Figure 5:
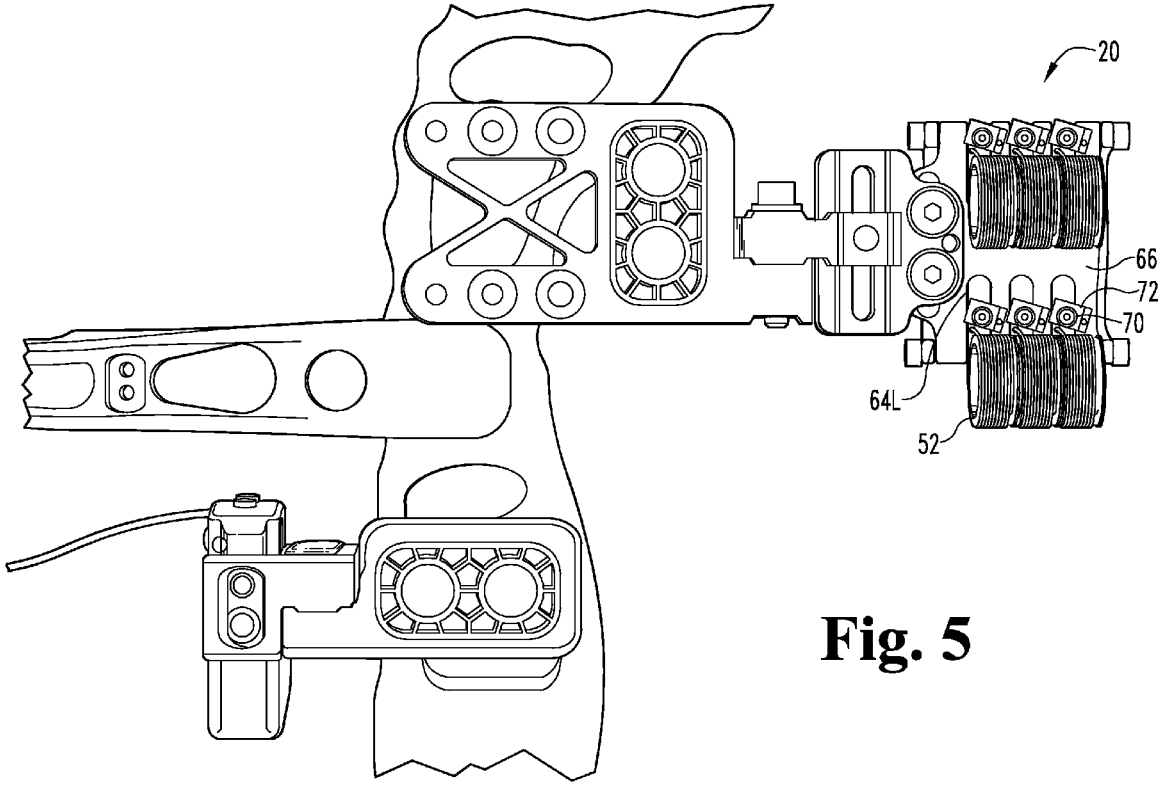
FIG. 5 is a right, side view of the bow sight of FIG. 2 shown mounted to a bow.
Figure 6:
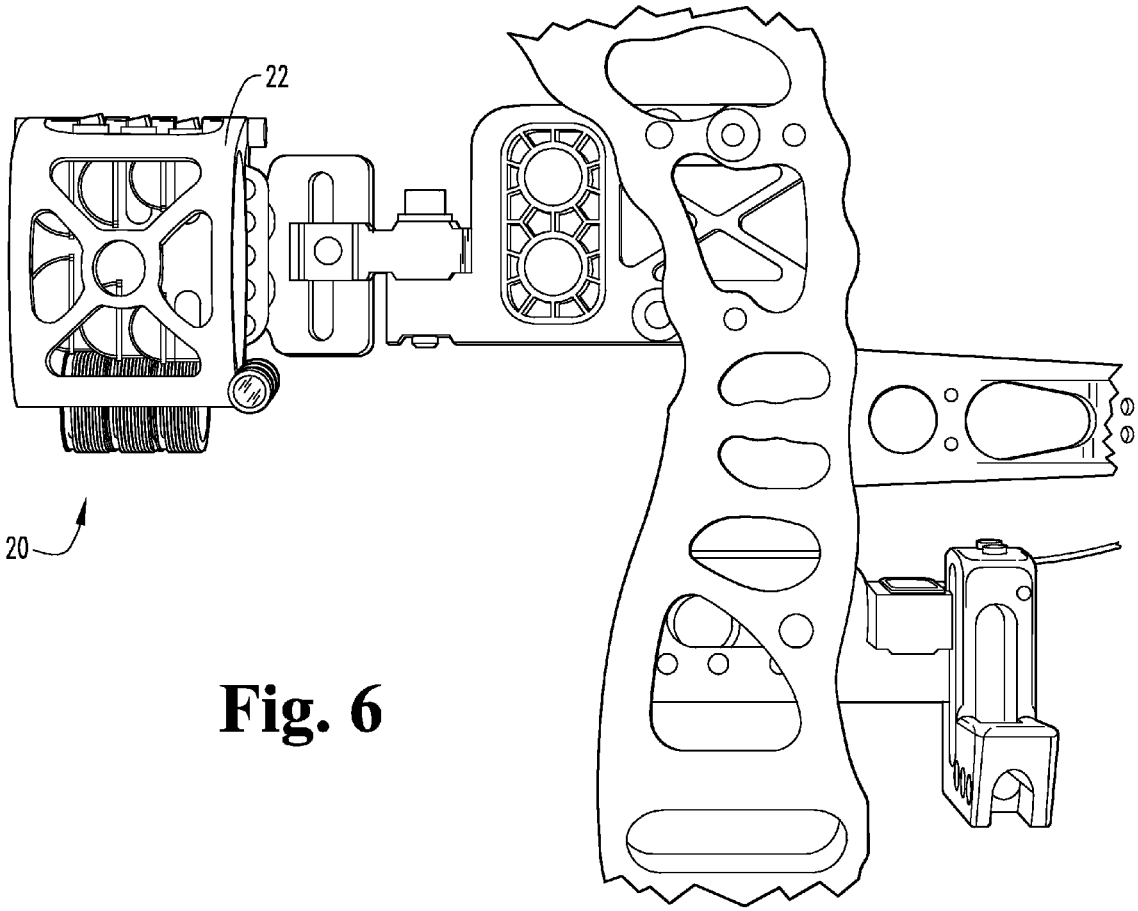
FIG. 6 is a left, side view of the bow sight of FIG. 2 shown mounted to a bow.
Figure 7:
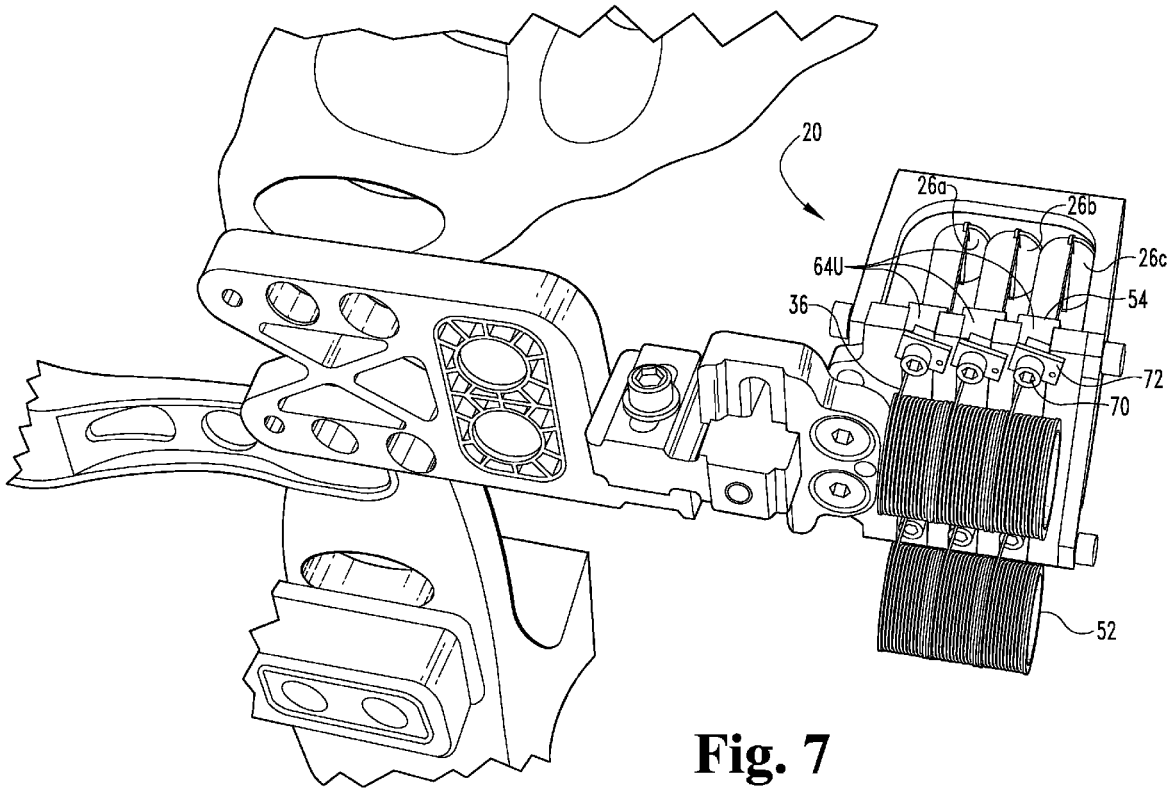
FIG. 7 is a right side, perspective view of the bow sight of FIG. 2 shown mounted to a bow.

As shown in FIGS. 2 and 2A, each of the sight pins 26*a-c* and 32*a-b* includes a sight point demarcation structure, generally designated 40, depicted as a first tick mark member 42 positioned to the left of the sight point 38 and a second tick mark member 44 positioned to the right of the sight point 38. The tick mark members 42, 44 project transversely outward from and preferably perpendicular to the vertical plane 30. Each of the tick mark members 42, 44 includes a pair of surfaces 46*a* and 46*b* that converge as the tick mark members 42, 44 extend away from the sight point 38. The converging surfaces 46*a*, and 46*b* meet at a point 48. The points 48 of the first and second tick mark members 42, 44 are preferably aligned along a horizontal line 51 (shown as a dashed line in FIG. 2A) that bisects the corresponding sight point 38.

In the depicted embodiment, the sight point 38 is defined by the light emitting end of the fiber optic member 36 held at the end of the sight pin projecting into the viewing opening. In alternative embodiments, the sight point 38 can be formed by any other type of structure such as an opening, a paint dot, a reflective dot, any other type of illuminating dot, or any point provided on the sight pin 26. Additionally, while it is preferred to have two tick mark members 42, 44 for each sight point 38, in other embodiments, it may be desirable to have only one tick mark member per sight point 38. Alternately, a sight pin could have three or more tick mark members radiating from the sight point.

As indicated previously, the sight pins 26*a-c* and 32*a-c* have vertical portions 28 that project into the viewing opening and which are aligned along the vertical plane 30. Immediately adjacent the sight points 38, the vertical portions 28 have defined widths W1. The sight point demarcation structures 40 preferably have widths W2 that are greater than the width W1 (see FIG. 2A). It will be appreciated that the widths are preferably measured in a direction generally transverse to the vertical plane 30. In certain embodiments, the sight point demarcation structures 40 define widths W2 that are at least 25% greater than the width W1. In other embodiments, the sight point demarcation structures 40 define widths W2 that are at least 50% greater than the width W1. In still other embodiments, the sight point demarcation structures 40 define widths W2 that are at least 75% greater than the widths W1. It is not necessary, however, that the widths W2 of the demarcation structures 40 be consistent as between the sight pins 26*a-c* and 32*a-c* in the bow sight 20. For example, it may be advantageous to have the demarcation structure 40 associated with the sight pin 32*a* corresponding to the longest target distance be smaller than the demarcation structure associated with the sight pin 26*a* corresponding to the shortest target distance.

As shown in FIGS. 2 and 2A, each of the tick mark members 42, 44 has a generally triangular shaped profile when viewed from the front side of the bow sight 20. It will be appreciated that other projections having other shapes suitable for demarking or improving sight point visibility can also be used. Examples of other usable shapes include flat tick mark members or curved tick mark members with points aligned along horizontal line 51 that bisects the corresponding sight point.

Gravity will affect archery shots. For example, when two arrows are shot different distances at the same speed, the longer shot will fall a greater distance than the shorter shot. To compensate for the effect of gravity for different shot distances, the sight points 38 of the sight pins 26*a-c* and 32*a-c* can be positioned at different vertical elevations relative to one another. Preferably, the sight pins 26*a-c* and 32*a-c* can be vertically adjusted relative to one another to set the vertical positions of the sight points 38. This allows an archer, through trial and error, to "sight in" a bow so that each sight point 38 is accurately associated with a particular target distance. The sight points 38 of the lower sight pins 32*a-c* would typically correspond to the longer target distances with the lowest sight point 38 (e.g., the sight point 38 of sight pin 32*c*) corresponding to the longest target distance. The sight points 38 of the upper sight pins 26*a-c* correspond to shorter target distances with the shortest upper sight pin 26*a* (shown at FIG. 4) defining the sight point 38 corresponding to the shortest shot distance. The positioning of the sight points 38 can be adjusted to be customized to the shooting characteristics of a particular hunter using a particular bow. In the depicted embodiment of FIGS. 2-7, three upper sight pins 26*a-c* and three lower sight pins 32*a-c* are provided. With a six-pin sight, it is common to set the sight points 38 to correspond to shooting distances such as 60, 50, 40, 30, 20 and 10 yards. However, other pin numbers and configurations can be used.

FIGS. 9-14 illustrate an example sight pin 26*a*. While the sight pin is labeled "26*a*", it will be appreciated that sight pins 26*b-c* and 32*a-c* have the same configuration, except the lengths of the vertical portions 28 can optionally vary. The vertical portions 28 may also extend upward or downward from the central portion depending on the desired mounting location.

Figure 9:
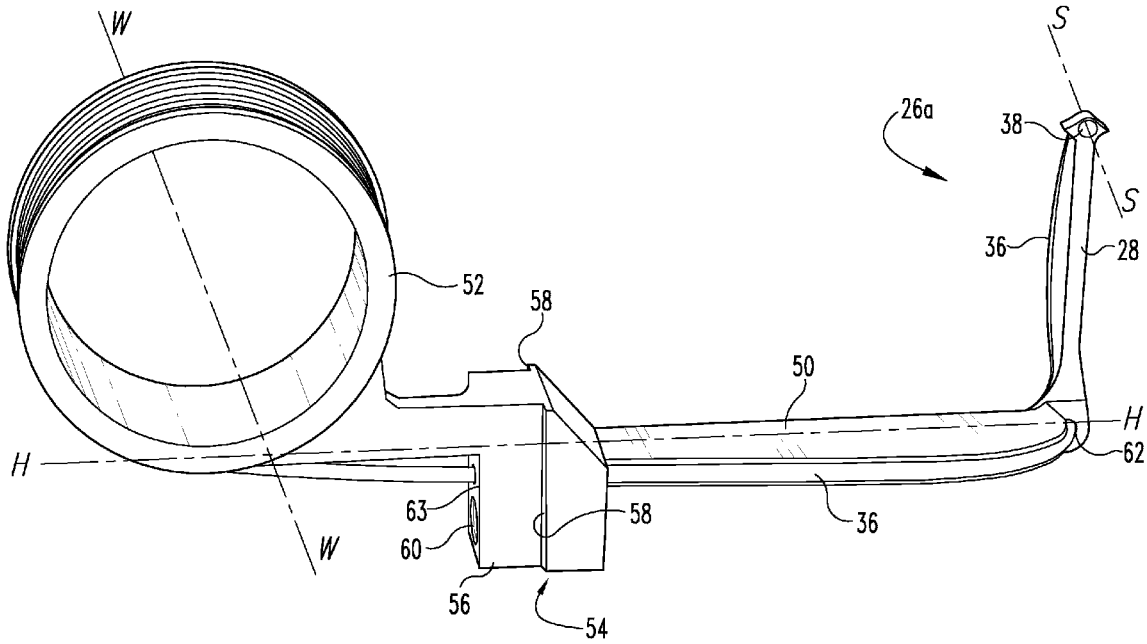
FIG. 9 is a front view of a sight pin used by the bow sight of FIG. 2.
Figure 10:
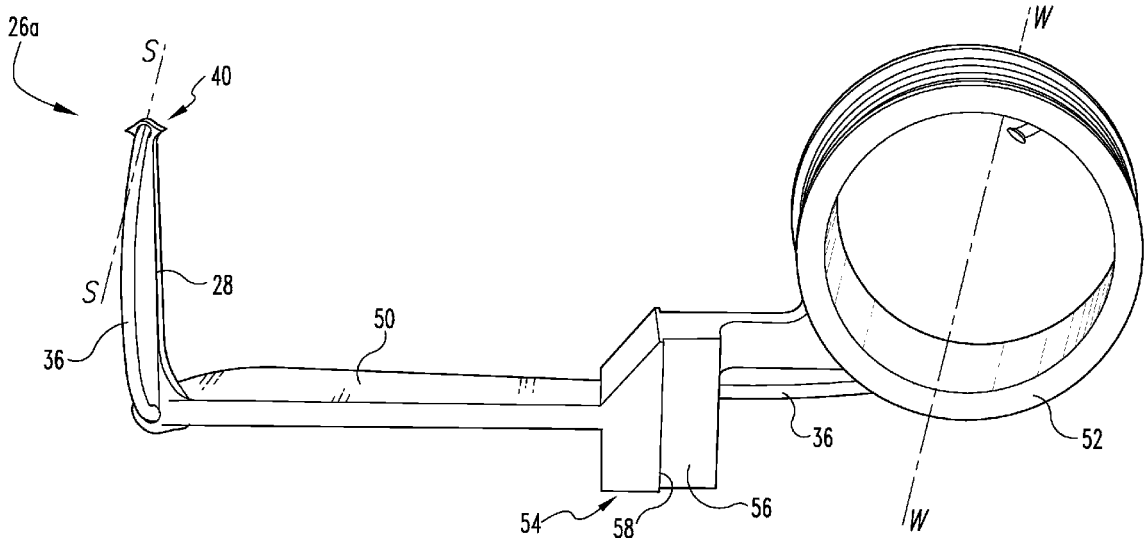
FIG. 10 is a rear view of the sight pin of FIG. 9.
Figure 11:
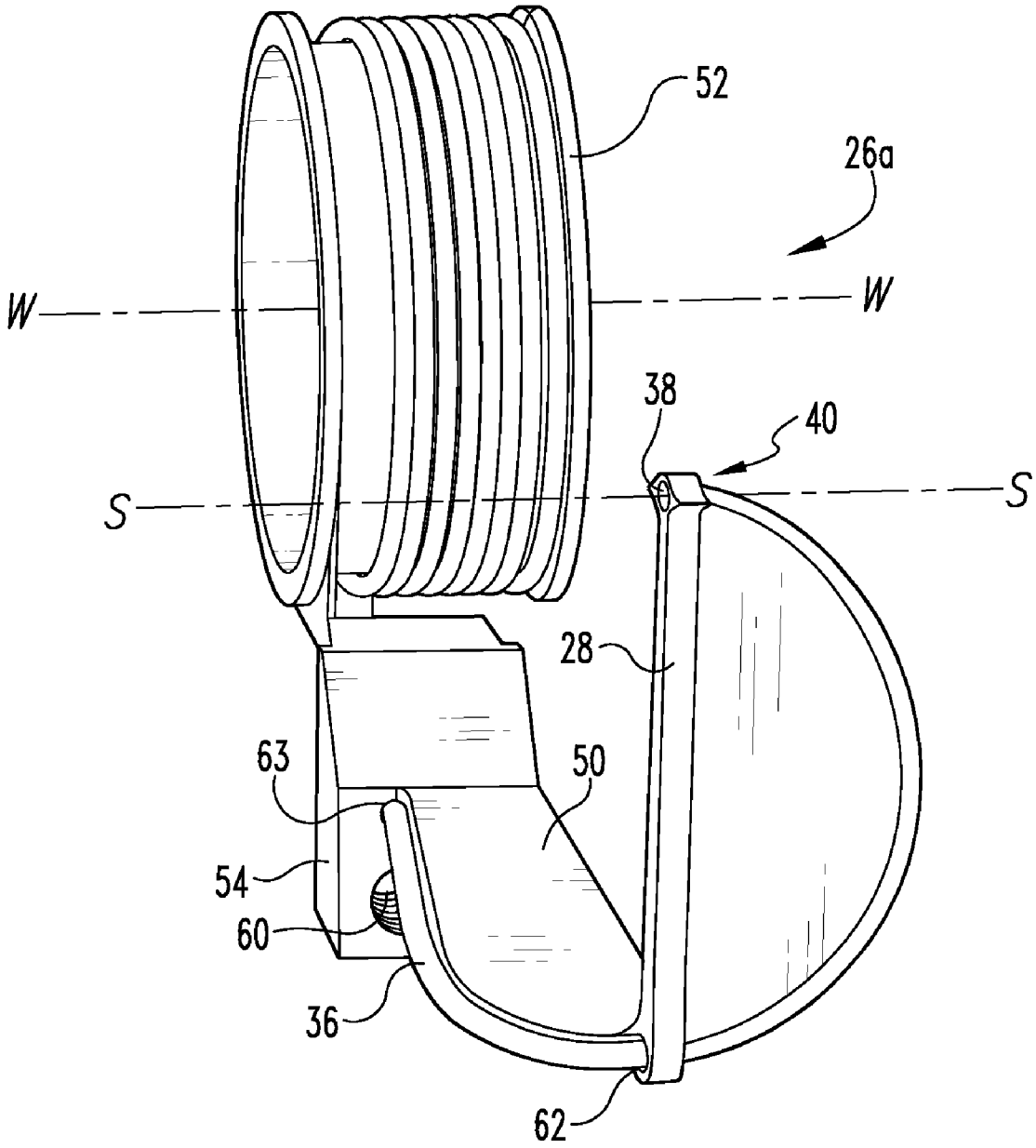
FIG. 11 is a right, side view of the pin of FIG. 9.
Figure 12:
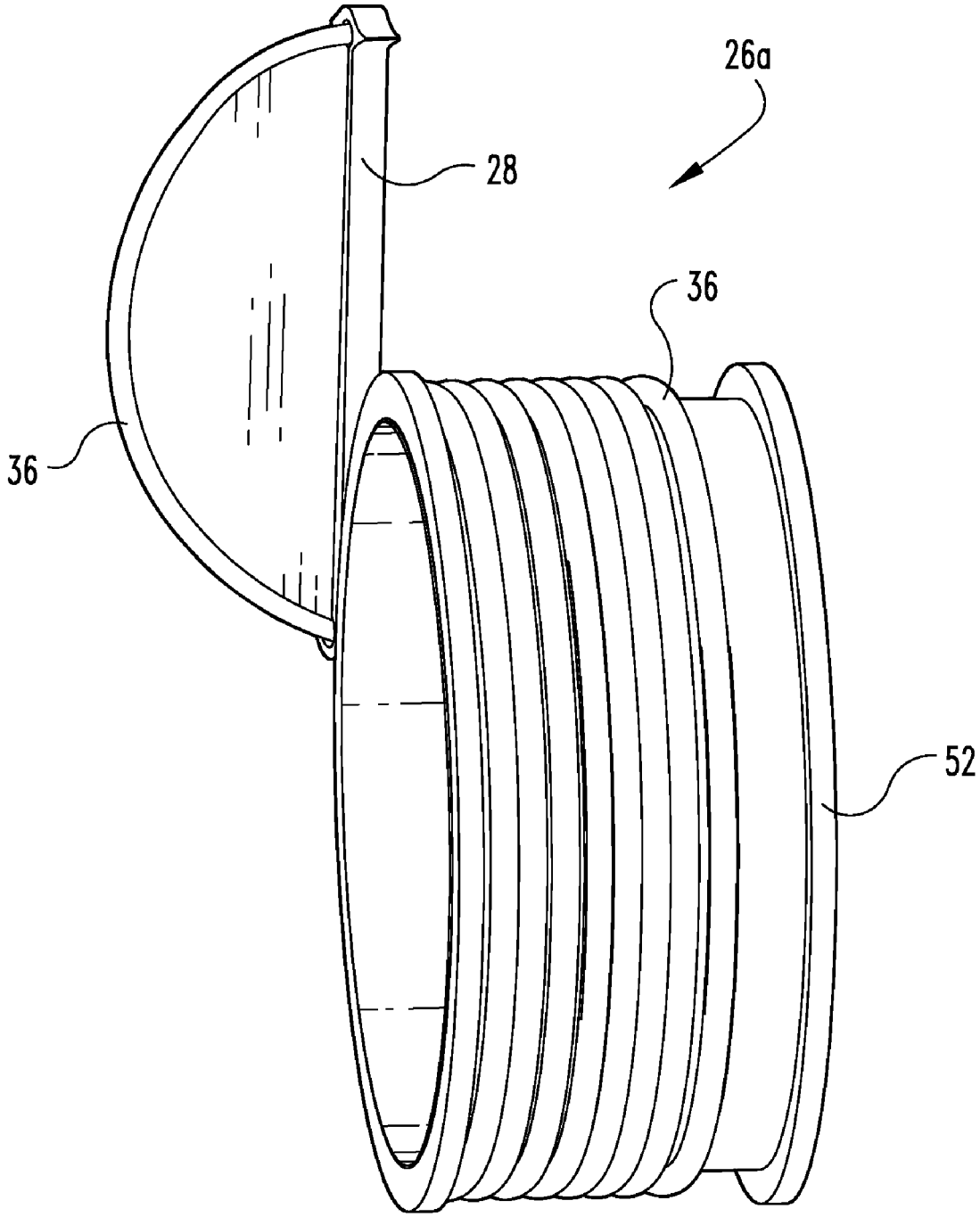
FIG. 12 is a left, side view of the pin of FIG. 9.
Figure 13:
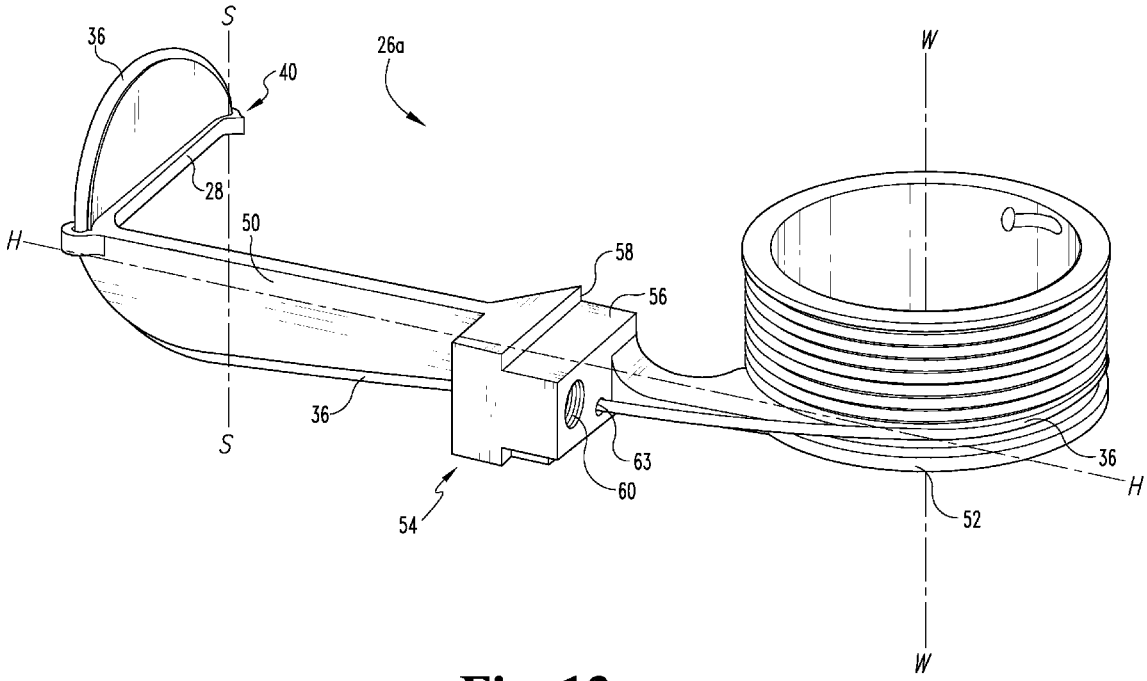
FIG. 13 is a bottom, perspective view of the sight pin of FIG. 9.
Figure 14:
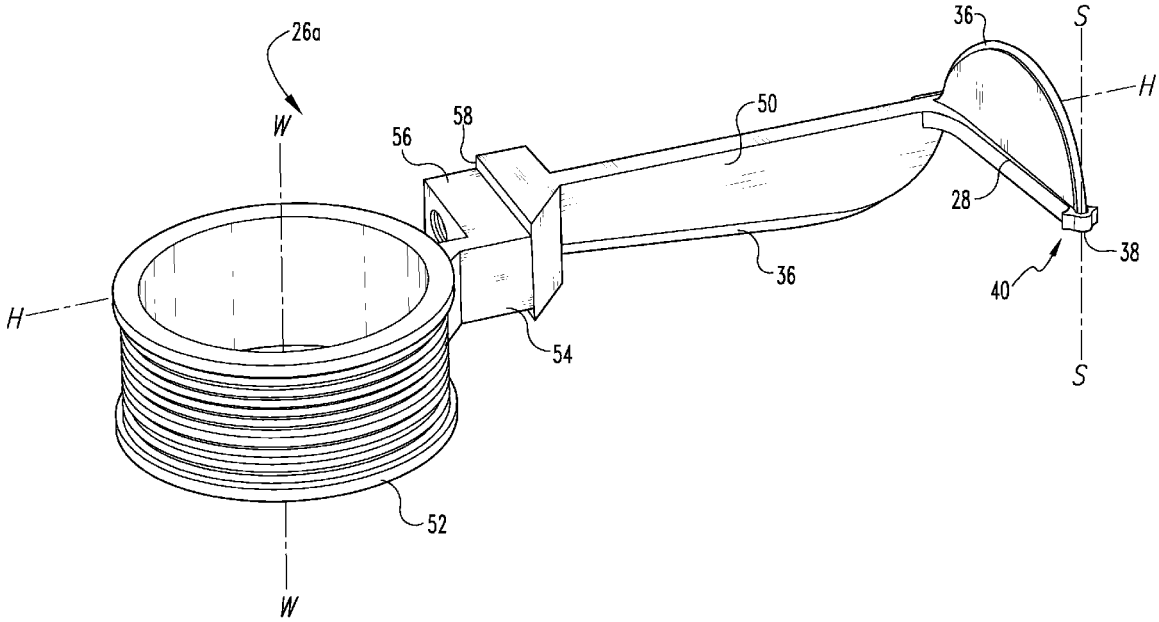
FIG. 14 is a top, perspective view of the sight pin of FIG. 9.

Referring to FIG. 9, sight pin 26*a* has a body which includes a vertical pin portion 28 integrally connected to a horizontal central portion 50. The horizontal portion 50 extends from the vertical portion 28 at one end to a spool portion 52 at an opposing end. The body can be formed of various appropriate materials such as plastic or metal and can be formed by machining, stamping, injection molding or other forming methods. In certain preferred embodiments, spool portion 52 has a central axis W substantially parallel to an axis S defined by the line through the sight point which an archer aligns with a target as the archer is aiming the bow.

A pin mounting portion 54 is positioned along the length of the horizontal portion 50. Pin mounting portion 54 is an example of how sight pin 26*b* can be mounted to housing 22. In this embodiment the pin mounting portion 54 includes a central guide portion 56 to be received within a slot in housing 22 and shoulders 58 that project outwardly from the guide portion 56 to abut housing 22 (see FIG. 8). A bolt hole 60, optionally threaded, extends through the pin mounting portion 54 in a direction generally parallel to the horizontal portion 50.

The sight pin 26*a* preferably includes the fiber optic member 36 which in this example defines the sight point 38 at a free end of the vertical portion 28. The light emitting end of the fiber optic member 36 is mounted facing the archer in an opening located at the free or extending end of the vertical portion 28 of the sight pin 26*a*. From the sight point 38, the length of the fiber optic member 36 extends along the back side of the vertical portion 28 and passes through an opening 62 defined through the vertical portion 28 adjacent the horizontal portion 50. After passing through the opening 62, the fiber optic member 36 extends along the front side of the horizontal portion 50 and may pass through a passage 63 defined through the pin mounting portion 54. In certain embodiments, vertical portion 28 and horizontal portion 50 define depths with radiused portions to minimize bends in the fiber optic member and grooves with sidewalls and a channel to receive and retain the diameter of the fiber optic member. A portion of the fiber optic member 36 is wrapped at least one revolution and preferably a plurality of times about the spool portion 52. The fiber optic pin can be held to the horizontal portion and vertical portions via tension between secured ends, a friction fit into a groove or can be secured with fasteners such as clamps or adhesive.

In certain embodiments, the spool portion is offset from the pin portion with the spool portion spaced away from the pin portion, for example outside of the housing. In this type of embodiment the sight pin passes through a side wall of housing 22 and the fiber optic member extends from the interior to the exterior of the housing.

The fiber optic member 36 is adapted to collect light along its length and convey the light to exit out at the sight point 38 defined at the end of the fiber optic member 36. It is desirable to maximize the brightness of the sight point 38. Preferably the visible surface area of the fiber optic member is maximized to allow a greater collection of light.

By providing a longer fiber optic member 36, the brightness of the sight point 38 can be increased. The spool portion 52 provides a mounting location for an extended length of optical fiber to be wrapped. The fiber optic member can be made in various colors, such as green, yellow or red. When multiple pins are used in a sight, multiple colors can be used to provide contrast between adjacent sight points.

Referring back to FIGS. 2-8, the sight housing 22 includes a base plate 66 with plurality of vertical slots 64 adapted for use in mounting the sight pins 26*a-c* and 32*a-c* to the sight housing 22. The vertical slots 64 includes an upper set of vertical slots 64U and a lower set of vertical slots 64L. The upper set of vertical slots 64U have upper ends that are open (see FIG. 7) to allow the pin mounting portions 54 of the sight pins 26*a-c* to be inserted into the slots. Similarly, the lower set of vertical slots 64L have open lower ends for allowing the pin mounting portions 54 of the sight pins 32*a-c* to be inserted into the lower set of vertical slots 64L.

Figure 8:
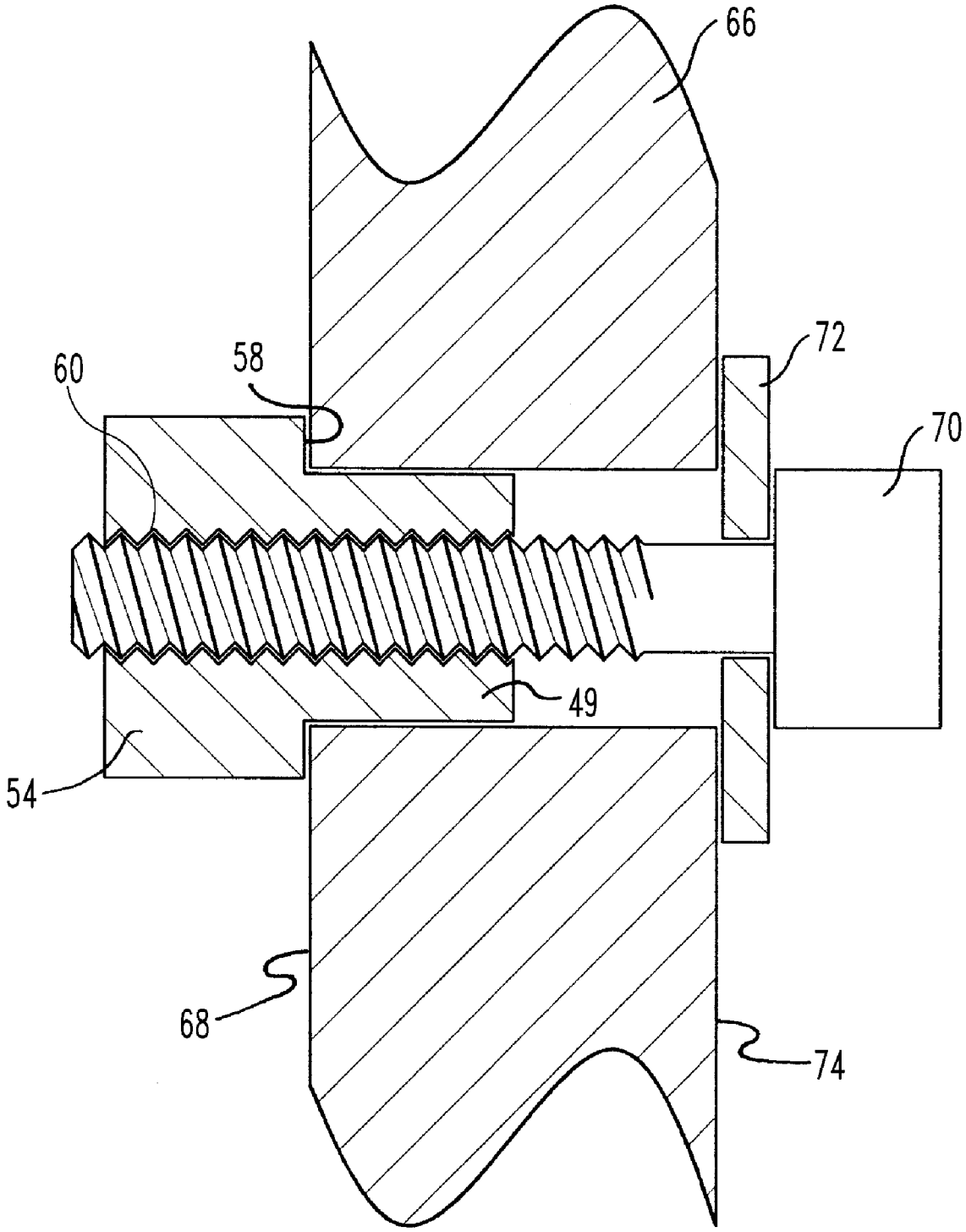
FIG. 8 is a cross-sectional view taken along section lines 8-8 of FIG. 2.

As illustrated in cross-section in FIG. 8, When the sight pins 26*a-c*, 32*a-c* are mounted to the base plate 66, the shoulders 58 of the mounting portions abut against a first side 68 of the base plate 66 and the guide portions 56 fit within the vertical slots 64. Set screws 70, for example with cap heads, are positioned with the cap heads on the opposite side of the base plate 66 from the mounting portions 54 and threaded into internal threading within bolt holes 60. The set screw can be tightened to lock the sight pins 26*a-c*, 32*a-c* with their sight points 38 at a desired elevation. Optionally, the heads of the set screws 70 abut against washers/collars 72 that abut against a second side 74 of the base plate 66. By tightening the set screw 70, the base plate 66 is compressed between the shoulders 58 and the washer 72 thereby causing the sight pins 26*a-c*, 32*a-c* to be frictionally locked in place. By loosening the set screw 70, the sight pins 26*a-c*, 32*a-c* can be slid up and down along the vertical slots 64 to change the elevation or height of the corresponding sight points 38.

The base plate 66 can include one or more bosses, texture such as ribs or other structures for facilitating attaching one or more mounting brackets that are useful in securing the sight housing 22 to a bow and locking the sight points in place. In certain embodiments, the brackets or other connecting structures can have structures for adjusting the vertical position of the sight housing 22 relative to the bow and can also include structure for adjusting the lateral position of the sight housing relative to the bow to account for windage. Furthermore, the brackets or other structures may include structure that allows the sight housing 22 to be pivoted relative to the bow to account for bow torque.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An archery device, comprising:

an archery bow sight housing mountable to an archery bow;

at least one vertical sight pin mounted to said housing with a portion extending from said housing into a viewing area;

at least one sight point defined at a height on said extending portion of said sight pin, such that the sight point is configured for an archer to align with a target as the archer is aiming a bow; and at least one tick mark member extending from said sight point transversely to the sight pin extending portion.

2. The archery device of claim 1, wherein said sight point defines a vertical plane bisecting said sight point and aligned between the archer and the target as the archer is aiming a bow, and where said at least one tick mark member extends horizontally from the vertical plane.

3. The archery device of claim 2, comprising a pair of tick marks member extending horizontally from opposing sides of said sight point.

4. The archery device of claim 3, wherein each of the tick mark members includes a pair of surfaces that converge to a point as the tick mark member extends away from the sight point, and wherein said points of said tick mark members are aligned along a horizontal line that bisects the sight point.

5. The archery device of claim 4, comprising a light emitting fiber mounted to the sight pin with a light emitting end facing the archer and defining said sight point.

6. The archery device of claim 4, wherein said points of said tick marks are separated by a horizontal width greater than the width of said sight pin extending portion.

7. The archery device of claim 1, comprising a plurality of vertical sight pins mounted to said housing and having sight points aligned in a vertical plane bisecting said vertical portions which is aligned between an archer and a target as the archer is aiming a bow, wherein each sight point has a pair of tick mark members extending transversely to the vertical plane.

8. The archery device of claim 7, comprising a archery bow riser mounted to said housing, an upper limb portion and a lower limb portion extending from said riser to outer limb tip portions, and a bowstring arrangement extending between said outer limb tip portions.

9. An archery device comprising a sight pin, wherein said sight pin has a spool portion with a central axis, a central portion extending from said spool portion and a pin portion integrally connected to and extending perpendicularly to said central portion at an opposing end of said control portion from said spool portion, wherein said pin portion defines at least one sight point along a line which an archer aligns with a target as the archer is aiming a bow, wherein said line is parallel to the central axis of said spool and a light emitting fiber arranged with a portion of said light emitting fiber wrapped around said spool and a length of said light emitting fiber extending along said central portion and said pin portion and wherein said light emitting fiber is arranged so that one end of the light emitting optic member faces an archer and defines said sight point.

10. The archery device of claim 9, wherein said central portion is horizontal and said pin portion is vertical.

11. The archery device of claim 10, wherein said sight pin is adjustably mounted to a sight housing to adjust the height of said sight point.

12. The archery device of claim 10, comprising a housing with a plurality of sight pins mounted to said housing, each sight pin having a vertical pin portion defining a sight point aligned in a vertical plane bisecting said sight points and aligned between an archer and a target as the archer is aiming a bow, wherein each sight pin has a spool portion with a central axis and a central portion extending from said spool portion which is integrally connected to and extends perpendicular to said pin portion, and a light emitting fiber arranged with a portion of said light emitting fiber wrapped around said spool, with a length of said light emitting fiber extending along said central portion and said pin portion and arranged so that one end of the light emitting optic member defines said sight point.

13. The archery device of claim 12, wherein each sight pin can be independently inserted into said housing to position the sight point in a viewing opening through which an archer peers when aiming a bow, and wherein each sight pin is adjustably mounted to said sight housing to allow independent adjustment of the height of said sight point.

14. The archery device of claim 10, wherein said fiber optic member has a length extending from said sight point along the back side of said pin portion to pass through an opening defined through said pin portion adjacent the central portion, wherein said fiber optic member length further extends along the front side of the central portion and through an opening defined through a pin mounting portion securable to a housing, and wherein a portion of said fiber optic member length is wrapped at least one revolution on said spool portion.

15. An archery bow, comprising:

a archery bow riser;

upper and lower limb portions extending from said riser to outer limb tip portions;

a bowstring arrangement extending between said outer limb tip portions;

an archery bow sight housing mounted to said riser and defining a viewing opening which an archer looks through when aiming the bow;

at least one sight pin mounted to said housing with a portion extending from said housing into a viewing area and defining at least one sight point such that the sight point in configured for an archer to align the sight point along a sight line with a target as the archer is aiming the bow;

wherein said sight point is defined on a pin portion of said sight pin, wherein said sight pin has a central portion extending from said pin portion transversely through a sidewall of said housing and wherein said sight pin has a spool portion spaced outside of said housing at an opposing end of said central portion from said pin portion.

16. The archery bow of claim 15, wherein said spool defines a central axis parallel to the sight line through said sight point.

17. The archery bow of claim 16, wherein said pin portion is arranged vertically within the viewing opening and wherein said pin portion is perpendicular to the sight line.

18. The archery bow of claim 17, wherein said sight pin is vertically adjustable to vertically adjust said sight point within the viewing opening.

19. The archery bow of claim 18, comprising a light emitting fiber arranged with a portion of said light emitting fiber wrapped around said spool and a length of said light emitting fiber extending along said central portion and said pin portion and wherein said light emitting fiber is arranged so that one end of the light emitting optic member faces an archer and defines said sight point.

20. The archery bow of claim 19, comprising a pair of tick marks extending from said sight point transversely to the sight pin portion.

* * * * *